US008205777B2

(12) United States Patent
Nishikawa et al.

(10) Patent No.: US 8,205,777 B2
(45) Date of Patent: Jun. 26, 2012

(54) FUEL, GAS, COMBUSTION TYPE POWER TOOL DRIVEN BY THE FUEL GAS, AND COMPRESSED GAS CONTAINER FOR THE COMBUSTION TYPE POWER TOOL

(75) Inventors: Tomomasa Nishikawa, Ibaraki (JP); Shinki Ohtsu, Ibaraki (JP); Yasuki Ohmori, Ibaraki (JP); Kunio Yamamoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 1144 days.

(21) Appl. No.: 11/285,019

(22) Filed: Nov. 23, 2005

(65) Prior Publication Data

US 2006/0129009 A1 Jun. 15, 2006

(30) Foreign Application Priority Data

Nov. 25, 2004 (JP) ..... P2004-340624

(51) Int. Cl.
*B25C 1/10* (2006.01)
*B25C 5/13* (2006.01)

(52) U.S. Cl. ..... 227/10; 227/130

(58) Field of Classification Search ..... 227/10, 227/130

See application file for complete search history.

(56) References Cited

U.S. PATENT DOCUMENTS 3,796,554 A * 3/1974 Meinass ..... 48/197 FM
4,403,722 A * 9/1983 Nikolich ..... 227/8
4,483,474 A * 11/1984 Nikolich ..... 227/8
4,522,162 A 6/1985 Nikolich
4,628,970 A 12/1986 Vasella
5,170,727 A * 12/1992 Nielsen ..... 110/346
5,197,646 A 3/1993 Nikolich
5,634,951 A * 6/1997 Colucci et al. ..... 44/415
5,676,180 A 10/1997 Teel
5,771,663 A 6/1998 Wold et al.
5,909,836 A * 6/1999 Shkolnikov et al. ..... 227/8
5,975,399 A * 11/1999 Oehri et al. ..... 227/120

(Continued)

FOREIGN PATENT DOCUMENTS

DE 28 23 305 12/1979

(Continued)

OTHER PUBLICATIONS

Chinese Office Action, w/ English translation thereof, issued in Chinese Patent Application No. 200510124167.X, dated Feb. 16, 2012.

*Primary Examiner* — Hemant M Desai
*Assistant Examiner* — Gloria R Weeks
(74) *Attorney, Agent, or Firm* — McDermott Will & Emery LLP

(57) ABSTRACT

A fuel gas has a gas including at least 40 weight % or more of 1-butene and propane, or at least 56 weight % or more of 1-butene and propylene. A combustion type power tool is driven by the fuel gas. A compressed gas container for a combustion type power tool has an inner side vessel filled with the fuel gas. When the fuel gas includes propane, 1-butene may be equal to or higher than 59 weight % and equal to or lower than 95 weight %. When the fuel gas includes propylene, the 1-butene may be equal to or higher than 70 weight % and equal to or lower than 96 weight %.

14 Claims, 6 Drawing Sheets

U.S. PATENT DOCUMENTS

| | | | | |
|---|---|---|---|---|
| 6,145,724 | A * | 11/2000 | Shkolnikov et al. | 227/8 |
| 6,247,626 | B1 * | 6/2001 | MacVicar | 227/10 |
| 6,886,730 | B2 * | 5/2005 | Fujisawa et al. | 227/8 |
| 6,896,794 | B2 * | 5/2005 | Towfighi | 208/17 |
| 6,951,194 | B2 * | 10/2005 | Nishikawa et al. | 123/46 R |
| 6,953,870 | B2 * | 10/2005 | Yan et al. | 585/14 |
| 6,994,240 | B2 * | 2/2006 | Jakob et al. | 227/8 |
| 7,063,052 | B2 * | 6/2006 | Nishikawa et al. | 123/46 SC |
| 7,416,100 | B2 * | 8/2008 | Fielitz | 227/8 |
| 7,455,036 | B2 * | 11/2008 | Nishikawa et al. | 123/46 SC |
| 7,458,493 | B2 * | 12/2008 | Nishikawa et al. | 227/10 |
| 2003/0051394 | A1 | 3/2003 | Towfighi | |
| 2004/0256037 | A1 * | 12/2004 | Towfighi | 149/1 |
| 2006/0129009 | A1 * | 6/2006 | Nishikawa et al. | 585/1 |

FOREIGN PATENT DOCUMENTS

| | | |
|---|---|---|
| EP | 1559514 A1 | 8/2005 |
| FR | 1 604 785 | 1/1972 |
| GB | 1167440 | 10/1969 |
| GB | 1 298 461 | 12/1972 |

* cited by examiner

FUEL, GAS, COMBUSTION TYPE POWER TOOL DRIVEN BY THE FUEL GAS, AND COMPRESSED GAS CONTAINER FOR THE COMBUSTION TYPE POWER TOOL

BACKGROUND OF THE INVENTION

1. Field of the Invention

The present invention relates to a fuel gas using for a combustion type power tool for striking a fastening piece of a nail, a rivet or the like by generating a power for driving a piston by igniting a mixture gas mixed with a flammable gas and air, the combustion type power tool driven by the fuel gas and a compressed gas container for the combustion type power tool.

2. Description of the Related Art

A combustion type power tool for striking a fastening piece of a nail, a rivet or the like (hereinafter, simply referred to as gas nailing machine) is shown in U.S. Pat. Nos. 4,522,162, 5,197,646 or the like.

A gas nailing machine has a housing including a main body outer frame, a cylinder provided in the housing, a piston reciprocated in the cylinder, a combustion chamber provided contiguous to the cylinder and the like, a compressed gas container filled with a liquefied gas including a fuel is attached in the housing, after injecting a fuel gas into the combustion chamber, the fuel gas is ignited by spark of an ignition plug, and the fastening piece is struck to wood or the like by driving the piston by explosive combustion of the fuel gas.

In a related art, as the fuel gas of the gas nailing machine, a gas of MAPP (methylacetylene, propadiene) or the like is generally used. However, methylacetylene is expensive and therefore, methylacetylene poses a problem in being used as a fuel gas of the gas nailing machine.

SUMMARY OF THE INVENTION

It is an object of the invention to provide an inexpensive fuel gas without deteriorating performance of a gas nailing machine.

According to an aspect of the invention, there is provided with a fuel gas for driving a combustion type power tool, including: at least 40 weight % or higher of 1-butene; and propane. The 1-butene may be equal to or higher than 59 weight %. The 1-butene may be equal to or lower than 95 weight %.

According to another aspect of the invention, there is provided with a fuel gas for driving a combustion type power tool, including: at least 56 weight % or higher of 1-butene; and propylene. The 1-butene may be equal to or higher than 70 weight %. The 1-butene may be equal to or lower than 96 weight %.

According to another aspect of the invention, there is provided with a combustion type power tool including: a housing; a head portion being provided at a vicinity of an end of the housing, and the head portion being formed with a fuel gas path; a cylinder being fixed to inside of the housing; a nose being extended to a lower side from a lower end portion of the cylinder; a push lever provided along the nose, the push lever being movable when the push lever is pressed to a workpiece; a piston reciprocally slidable to the cylinder in an axial direction of the cylinder, the piston being capable of partitioning the cylinder into a piston lower chamber and a piston upper chamber in the cylinder; a combustion chamber frame being movably guided at inside of the housing, the combustion chamber frame capable of being brought into contact with and being separated from the head portion in cooperation with movement of the push lever, the combustion chamber frame forming a combustion chamber with the head portion and the piston; and a connecting unit being extended along a side face of the cylinder, for connecting the push lever and the combustion chamber frame. The combustion type power tool is driven by a fuel gas. The fuel gas comprises at least 40 weight % or higher of 1-butene and propane. The 1-butene may be equal to or higher than 59 weight %. The 1-butene may be equal to or lower than 95 weight %.

According to another aspect of the invention, there is provided with a combustion type power tool including: a housing; a head portion being provided at a vicinity of an end of the housing, and the head portion being formed with a fuel gas path; a cylinder being fixed to inside of the housing; a nose being extended to a lower side from a lower end portion of the cylinder; a push lever provided along the nose, the push lever being movable when the push lever is pressed to a workpiece; a piston reciprocally slidable to the cylinder in an axial direction of the cylinder, the piston being capable of partitioning the cylinder into a piston lower chamber and a piston upper chamber in the cylinder; a combustion chamber frame being movably guided at inside of the housing, the combustion chamber frame capable of being brought into contact with and being separated from the head portion in cooperation with movement of the push lever, the combustion chamber frame forming a combustion chamber with the head portion and the piston; and a connecting unit being extended along a side face of the cylinder, for connecting the push lever and the combustion chamber frame. The combustion type power tool is driven by a fuel gas. The fuel gas comprises at least 56 weight % or higher of 1-butene and propylene. The 1-butene may be equal to or higher than 70 weight %. The 1-butene may be equal to or lower than 96 weight %.

According to another aspect of the invention, there is provided with a compressed gas container for a combustion type power tool, including: an outer side vessel; an inner side vessel being provided at inside of the outer side vessel, and the inner side vessel being filled with a fuel gas; a valve capable of injecting the fuel gas in the inner side vessel to outside of the outer side vessel; and a metering valve being selectively connectable to the valve, the metering valve being capable of measuring an amount of injecting the fuel gas. The fuel gas comprises at least 40 weight % or higher of 1-butene and propane. An amount of the 1-butene may be equal to or higher than 59 weight %. The amount of the 1-butene may be equal to or lower than 95 weight %.

According to another aspect of the invention, there is provided with a compressed gas container for a combustion type power tool, including: an outer side vessel; an inner side vessel being provided at inside of the outer side vessel, and the inner side vessel being filled with a fuel gas; a valve capable of injecting the fuel gas at inside of the inner side vessel to outside of the outer side vessel; and a metering valve selectively connectable to the valve, the metering valve being capable of measuring an amount of injecting the fuel gas. The fuel gas comprises at least 56 weight % or higher of 1-butene and propylene. The 1-butene may be equal to or higher than 70 weight %. The 1-butene may be equal to or lower than 96 weight %.

DESCRIPTION OF THE PREFERRED EMBODIMENTS

A detailed explanation of the embodiments will be given along with the explanation.

Figure 1:
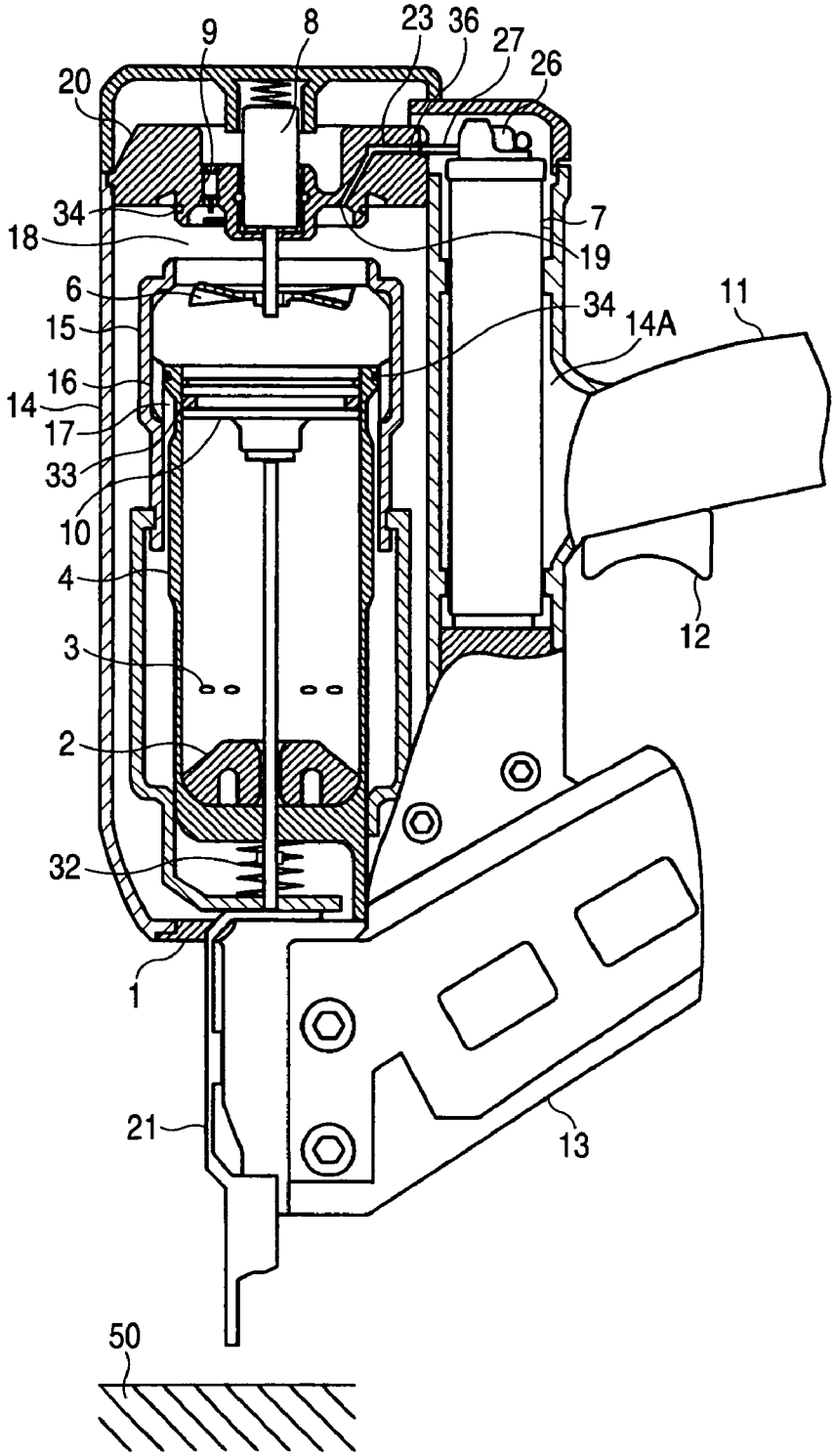
FIG. 1 is a sectional view in a stationary state of a combustion type power tool according to an embodiment of the invention.
Figure 2:
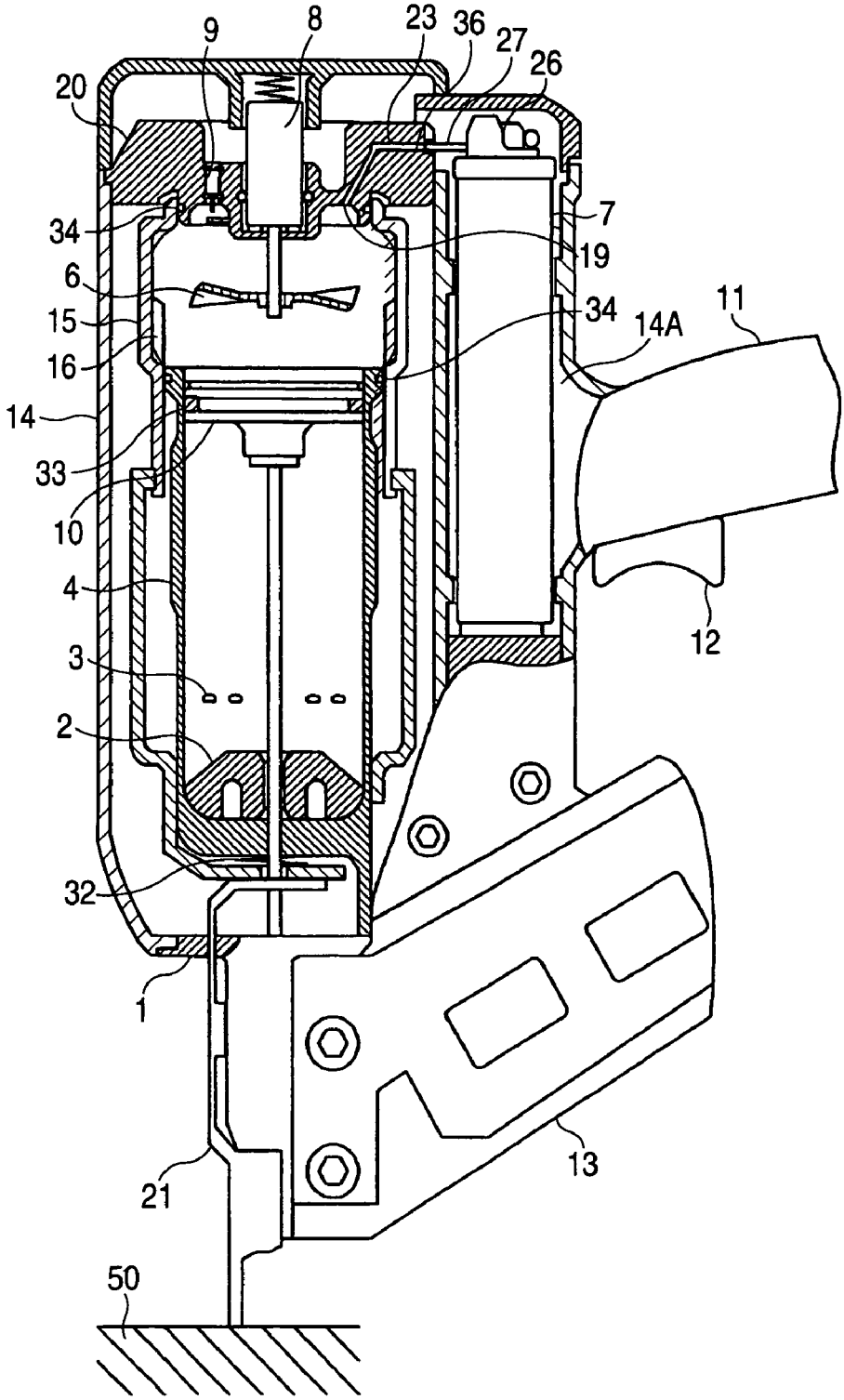
FIG. 2 is a sectional view in a state of striking a fastening piece by the combustion type power tool according to the embodiment.

FIG. 1, FIG. 2 show an embodiment of applying a combustion type power tool to a gas nailing machine, FIG. 1 shows a sectional view in a stationary state before striking a nail, and FIG. 2 shows a sectional view in striking the nail.

A housing 14 forming a main body frame is provided with a handle 11, a tail cover 1, a push lever 21, a magazine 13, and a trigger 12, and inside of the housing 14 is installed with a cylinder 4, a bumper 2, a piston 10, a fan 6, a motor 8, an ignition plug 9, an injection port 19, a compressed gas container 7, a combustion chamber frame 15, a head cover 20 and the like.

At inside of the housing 14, although the cylinder 4 and the head cover 20 are fixed to the housing 14, the combustion chamber frame 15 is guided by the housing 14 and the cylinder 4, urged in a direction of striking a nail, that is, in a lower direction of the drawing by a spring 32 and is made to be movable in an axial direction of the housing 14. A space of combusting a mixture gas of a fuel gas 30 and air, that is, a combustion chamber is formed by a space closed by the combustion chamber frame 15, the head cover 20 and the piston 10. The movable piston 10 via a sliding seal member 33 is installed with inside of the cylinder 4. A lower side of the cylinder 4 is provided with an exhaust hole 3, a check valve (not illustrated) above the exhaust hole 3 and the bumper 2 to which the piston 10 is butted. Inside of the combustion chamber is provided with the fan 6 rotatable by the motor 8 provided at an upper portion of the head cover 20, the ignition plug 9 ignited by operating the trigger 12, the injection port 19 for injecting the fuel gas 30 supplied from the compressed gas container 7, a rib projected to an inner side in a radius direction, that is, a combustion chamber fin 16 and the like.

A lower side of the housing 14 is attached with the magazine 13 charged with nails (not illustrated), the tail cover 1 for guiding the nail fed from the magazine 13 to set to a lower side of the piston 10. Further, a seal member 34 of, for example, an O ring or the like is provided at an upper end of the cylinder 4 and a lower end of the head cover 20.

In the stationary state shown in FIG. 1, by urging by the spring 32, the push lever 21 is projected to a lower side from a lower end of the tail cover 1. At this occasion, there is a gap 17 between a lower side of the combustion chamber frame 15 continuous to the push lever 21 and an upper end of the cylinder 4 and at the same time, there is also a gap 18 between an upper end of the combustion chamber frame 15 and a lower side of the head cover 20. The piston 10 is stopped at a position of an upper dead center in the cylinder 4.

When the handle 11 is gripped and a front end of the push lever 21 is pressed to wood 50 under the state, the push lever 21 is moved up against the spring 32, and also the combustion chamber frame 15 continuous to the push lever 21 is moved up to be brought into a state as shown by FIG. 2. That is, by moving up the combustion chamber frame 15, the gaps 17, 18 on the lower side and the upper side of the combustion chamber frame 15 are closed and hermetically sealed by the seal member 34. That is, the combustion chamber is formed. In cooperation with moving up the push lever 21, thereafter, the compressed gas container 7 is pressed, the fuel gas 30 is injected from the injection port 19 into the combustion chamber, further, the motor 8 is turned ON and the fan 6 is rotated. By rotating the fan 6 in the combustion chamber including a hermetically sealed space, in cooperation with the combustion chamber fin 16 projected into the combustion chamber, the injected fuel gas 30 is stirred to mix with air in the combustion chamber.

When the trigger 12 is turned ON thereafter, the ignition plug 9 is sparked and the mixture gas of the fuel gas 30 and air is ignited. The combusted and expanded gas moves the piston 10 to a lower side and strikes the nail in the tail cover 1 to the wood 50.

After striking the nail, the piston 10 is brought into contact with the bumper 10, and the combustion gas is exhausted to outside of the cylinder 4 from the exhaust hole 3. The exhaust hole 3 is accompanied by the check valve as described above, and the check valve is closed at a time point at which the combustion gas is exhausted to outside of the cylinder 4 and the cylinder 4 and inside of the combustion chamber are brought under the atmospheric pressure. The combustion gas remaining in the cylinder 4 and inside of the combustion chamber is at a high temperature after combustion, by absorbing heat of the combustion gas by an inner wall of the cylinder 4, an inner wall of the combustion chamber frame 15, the combustion chamber fin 16 or the like, the combustion gas is rapidly cooled, the pressure in the combustion chamber is lowered to be equal to or lower than the atmospheric pressure (referred to as thermal vacuum) and the piston 10 is pulled back to the initial upper dead center position.

Thereafter, when the trigger 12 is turned OFF, the gas nailing machine 100 is moved up, and the push lever 21 is separated from the wood 50, the push lever 21 and the combustion chamber frame 15 are moved back to the lower side by being urged by the spring 32 to be brought into the state as shown by FIG. 1. At this occasion, even when the trigger 12 is turned OFF, the fan 6 is continued to rotate for a predetermined time period by a control of a control portion (not illustrated). In the state shown in FIG. 1, the gaps 17, 18 are produced on the upper side and the lower side of the combustion chamber frame 15, by generating a flow by the fan 6, clean air is taken in from a suction port (not illustrated) at an upper face of the housing 14, and a combustion gas is delivered from the exhaust port (not illustrated) to the housing 14 to thereby sweep air in the combustion chamber. Thereafter, the fan 6 is stopped to bring about an initial stationary state.

Figure 3:
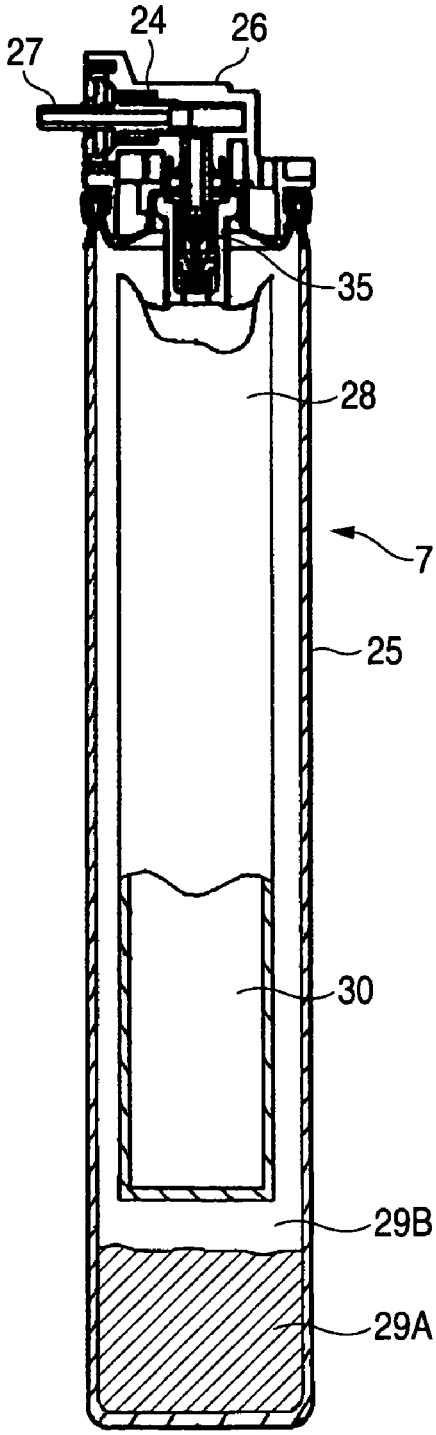
FIG. 3 is a partially sectional side view of a compressed gas container according to another embodiment of the invention.

Next, an explanation will be given in reference to FIG. 3 showing an embodiment of a compressed gas container according to another embodiment.

The compressed gas container 7 includes an outer side vessel 25 forming a main body can, an inner side vessel 28 provided at inside of the outer side vessel 25, and a main body valve 35 held by the outer side vessel 25 for injecting the fuel gas 30 filled at inside of the inner side vessel 28 to outside of the compressed gas container 7. Further, a metering valve 26 for supplying a predetermined amount of the fuel gas 30 to the gas nailing machine 100 is attached attachably and detachably to and from the compressed gas container 7.

A metal vessel of an aluminum can, a steel can or the like is used for the outer side vessel 25, and the inner side vessel 28 is formed by a structure laminated with a metal film of aluminum or the like and a resin member of polyurethane, polyethylene or the like. Inside of the outer side vessel 25 is filled with a propulsion gas 29 for extruding the fuel gas 30 filled at inside of the inner side vessel 28 to outside of the compressed gas container 7. Further, as the main body valve 35, there is used a valve for bringing inside of the inner side vessel 28 and outside of the compressed gas container 7 into a communicated side (total amount injection) during a time period of opening the main body valve 35.

The propulsion gas 29 is filled in a state of two layers of a liquid 29A and a gas 29B, and even when the fuel gas 30 of the inner side vessel 28 is injected to outside of the compressed gas container 7 and a volume of a region of the propulsion gas 29 at inside of the compressed gas container 7 is changed, the inner side vessel 28 can be pressed substantially by a constant pressure by vaporizing the propulsion gas 29 in the liquid state. A gas of, for example, propane or butane is used for the propulsion gas 29.

The fuel gas 30 is brought into a state of being always compressed by the propulsion gas 29 to be able to be preserved in a state of a liquid. The fuel gas 30 is filled with gases of 1-butene, propane or propylene or the like in a state of a liquid. Further, a lubricant or the like may be mixed to the fuel gas 30 in order to improve operation of a sliding portion of the gas nailing machine 100.

The metering valve 26 is constructed by a constitution of pressing the main body valve 35 in an opened state by being attached of a compressed gas container 7 for communicating the inner side vessel 28 and a measuring chamber 24 of the metering valve 26. Further, according to the measuring chamber 24, when a measuring valve stem 27 is pressed to an inner side of the metering valve 26, a liquefied gas path between the measuring chamber 24 and the main body valve 35 is shut off and a predetermined amount of a liquefied gas can be injected from the measuring valve stem 27.

Further, by attaching the metering valve 26 to the compressed gas container 7, there is brought about a state of being filled always with the liquefied gas and therefore, when the compressed gas container 7 is preserved by itself, it is preferable to bring the metering valve 26 into a state of being removed from the compressed gas container 7.

When the compressed gas container 7 is attached to a main body of the gas nailing machine 100, the metering valve 26 is attached to the compressed gas container 7, the compressed gas container 7 is inserted into a chamber 14A of the gas nailing machine 100, and the measuring valve stem 27 is engaged with a stem engaging portion 36 of the gas nailing machine 100. The liquefied gas injected from the measuring valve stem 27 is injected by being vaporized to expand to the combustion chamber by way of a fuel path 23 of the head cover 20.

An explanation will be given as follows of an embodiment of the fuel gas 30 in reference to FIG. 4 through FIG. 7.

Further, the fuel gas 30 can use other than a gas component shown below and in that occasion, it is further preferable to select the fuel gas 30 to satisfy at least (1), further, select to satisfy conditions of (2), (3). Further, by mixing a lubricant along with the fuel gas 30, operation of the gas nailing machine 100 can be improved and service life thereof can be prolonged.

The fuel gas 30 including a drive source of the gas nailing machine 100 is supplied by the compressed gas container 7. Therefore, it is preferable that the fuel gas 30 is flammable by a small amount. Further, the fuel gas 30 injected into the combustion chamber cannot be combusted when an amount of the fuel gas is excessively large or excessively small and therefore, it is preferable that a range of a flammable fuel gas amount is wide.

Figure 4:
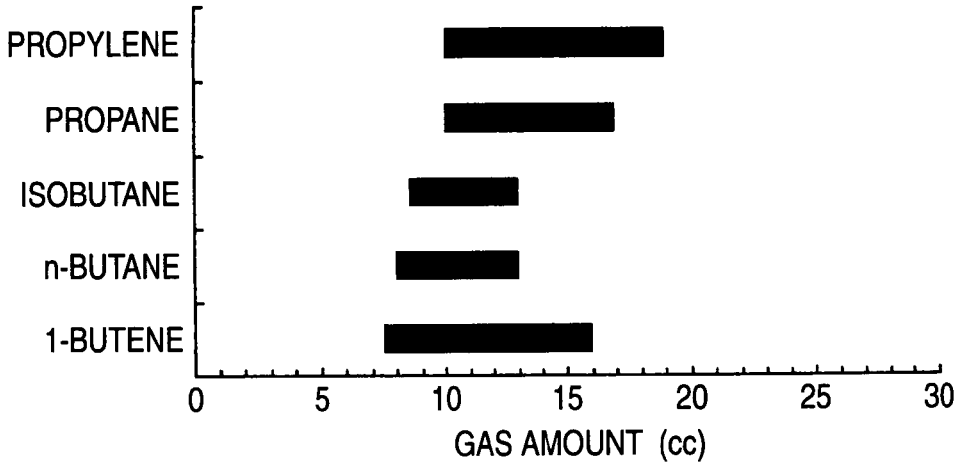
FIG. 4 is a diagram showing an ignitable range of a gas.

FIG. 4 is a graph showing an experimental result of comparing an amount of the fuel gas 30, (liquefied gas) which can be combusted actually by injecting the liquefied fuel gas to the gas nailing machine 100 having a volume of the combustion chamber of about 273 cc. It has been found from FIG. 4 that 1-butene can be ignited in a range of 7.5 through 16 cc and a range of a flammable gas amount by a small amount is wide.

Figure 5:
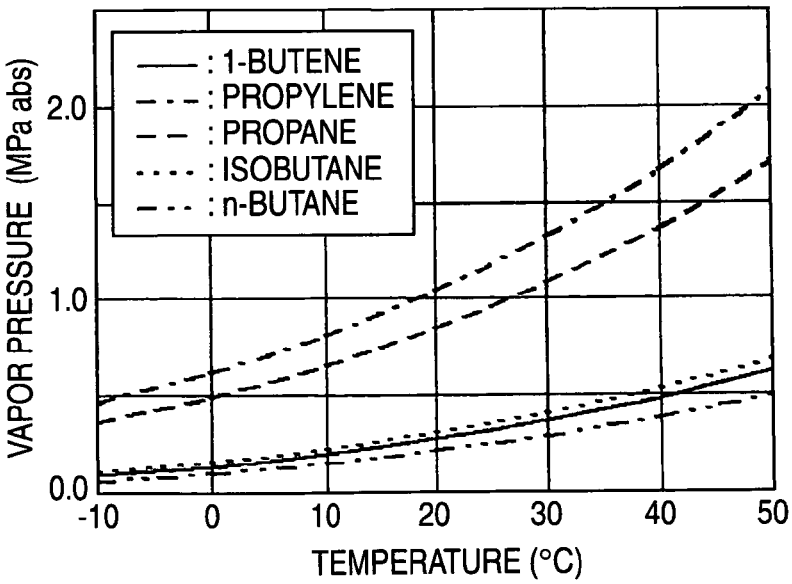
FIG. 5 is a diagram showing a vapor pressure-temperature characteristic of a gas.

FIG. 5 shows vapor pressure (absolute pressure)-temperature characteristics of respective single gases which are generally known. Although the gas nailing machine 100 is used at a surrounding temperature of about −10 through +40° C., when the vapor pressure of the fuel gas 30 becomes equal to or lower than the atmospheric pressure at −10° C., there is a concern that the liquefied gas is not vaporized. Here, taking a look at 1-butene, mentioned above, it is found that the vapor pressure is low. Therefore, when the fuel gas 30 is constituted only by 1-butene, there poses a problem that the fuel gas 30 is not vaporized at low temperatures and cannot be injected. It has been found that the problem is resolved by using 1-butene along with propane or propylene having a high vapor pressure.

Figure 6:
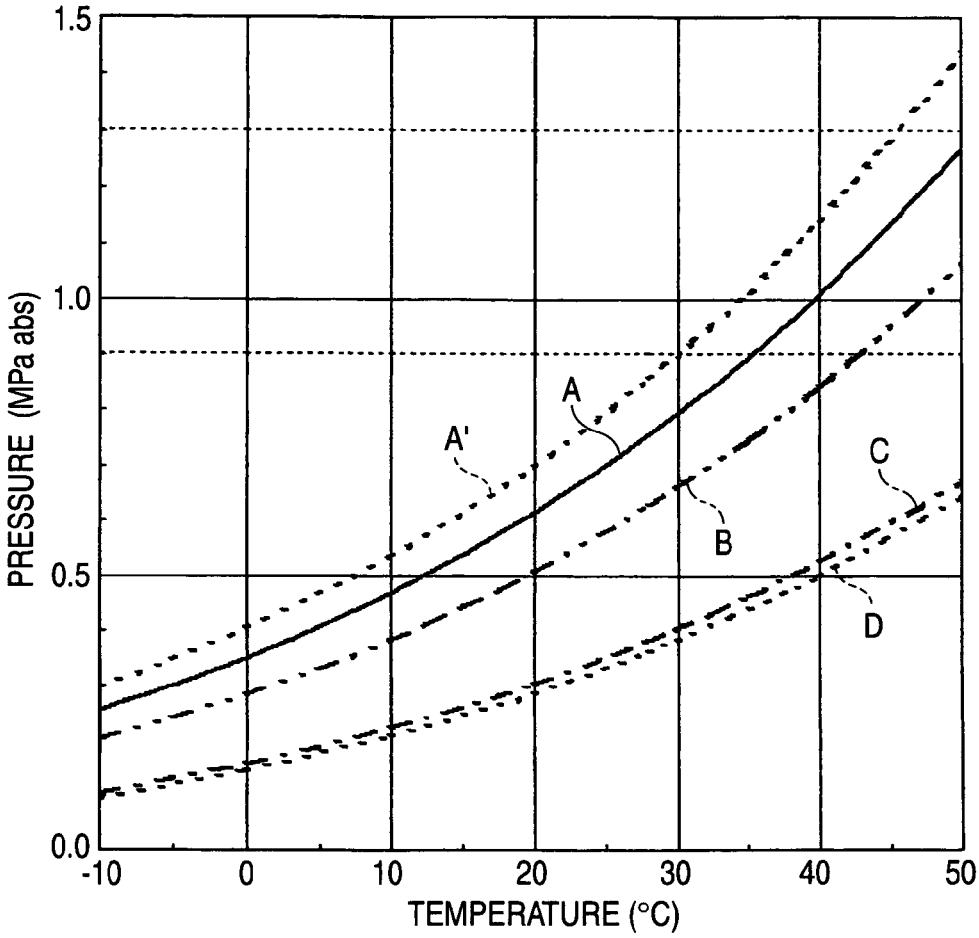
FIG. 6 is a diagram showing a vapor pressure-temperature characteristic of a mixture gas of 1-butene and propane.
Figure 7:
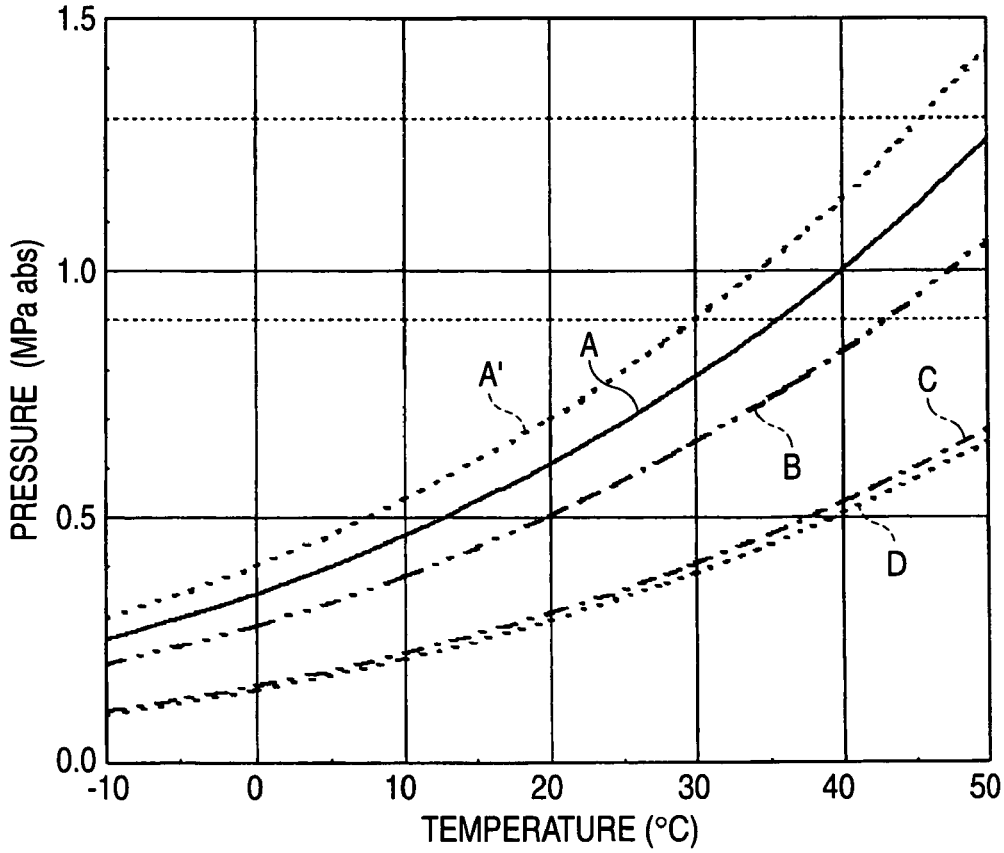
FIG. 7 is a diagram showing a vapor pressure-temperature characteristic of a mixture gas of 1-butene and propylene.

FIG. 6, FIG. 7 show vapor pressure (absolute pressure)-temperature characteristics of mixture gases changing rates thereof in fuel gases using 1-butene and propane or propylene.

An explanation will be given of FIG. 7 as follows.

In determining the rate of 1-butene and propane, points are constituted by the following points.

(1) When the vapor pressure of the mixture gas becomes high, a vessel and a valve having high pressure tightness need to be used for the compressed gas container 7 and the metering valve 26. According to the vessel of this kind, when a compressed gas container inner pressure is equal to or lower than 0.8 MPa (gage pressure) at 35° C. and 1.2 MPa (gage pressure) at 50° C., it is not necessary to use a vessel or a valve having high pressure tightness and a general purpose vessel can be used and therefore, an inexpensive compressed gas container can be provided. On the other hand, in order to maintain the fuel gas 30 in a liquefied state, it is necessary to establish a relationship shown below.

propulsion gas pressure>fuel gas pressure

So far as the pressure of the propulsion gas 29 satisfies the above-described relationship, component, mixture gas rate, filling amount and the like may pertinently be selected, and there may be constituted a gas rate by which at lest the pressure of the fuel gas 30 becomes equal to or lower than 0.8 MPa (gage pressure) at 35° C. and 1.2 MPa (gage pressure) at 50° C.

It is found that the condition is satisfied when 1-butene is equal to or higher than 40 weight %, and a curve A of FIG. 6 shows a vapor pressure (absolute pressure)-temperature characteristic when 1-butene 40 is 40 weight % and propane is 60 weight %.

Further, a curve A' shows a vapor pressure (absolute pressure)-temperature characteristic when 1-butene is 25 weight % and propane is 75 weight % (outside of the range of the embodiment).

(2) The inner side vessel 28 at inside of the compressed gas container 7 is frequently constituted by a structure laminated with a resin and an aluminum foil, and when temperature of the compressed gas container 7 becomes low, the inner side vessel 28 is hardened, and it becomes difficult to extrude the fuel gas 30 at the inner portion of the inner side vessel 28 by the propulsion gas 29. Therefore, it is found that the vapor pressures of the fuel gas 30 and the propulsion gas 29 are made to differ from each other and when there is a difference therebetween by about 0.05 MPa at −10° C., the fuel gas 30 can firmly be injected at low temperatures.

It is found that the condition is satisfied when 1-butene is equal to or higher than 59 weight % and a curve B of FIG. 6 shows a vapor pressure (absolute pressure)-temperature characteristic of a mixture gas when 1-butene is 59 weight % and propane is 41 weight %.

(3) In order to vaporize the fuel gas 30 at low temperatures, it is necessary that the pressure is equal to or higher than at least 1 atmospheric pressure (absolute pressure) at −10° C. as mentioned above. It is found that the condition is satisfied when 1-butene is equal to or lower than 95 weight %.

A curve C of FIG. 6 shows a vapor pressure (absolute pressure)-temperature characteristic when 1-butene is 95 weight % and propane is 5 weight %.

Further, a curve D of FIG. 6 shows a vapor pressure (absolute pressure)-temperature characteristic when 1-butene is 98 weight % and propane is 2 weight % (outside of the range of the embodiment).

FIG. 7 is a diagram showing vapor pressure (absolute pressure)-temperature characteristics of mixture gases changing a rate of mixing 1-butene and propylene and shows a result of calculating rates of satisfying the above-described three conditions. A curve A of FIG. 7 shows a vapor pressure (absolute pressure)-temperature characteristic of 56 weight % of 1-butene, 44 weight % of propylene, a curve B shows that of 70 weight % of 1-butene, 30 weight % of propylene, a curve C shows that of 96 weight % of 1-butene, 4 weight % of propylene, a curve D shows that of 98 weight % of 1-butene, 2 weight % of propylene (outside of the range of the embodiment), a curve A' shows that of 44 weight % of 1-butene, 56 weight % of propylene (outside of the range of the embodiment).

By the above-described, according to the embodiments, the combustion type power tool can be driven by a small amount of the gas, further; the inexpensive compressed gas container can be provided by using a compressed gas container vessel and a valve of general purpose products.

According to the embodiments, even when the inner side vessel is hardened at low temperatures, the fuel gas can firmly be extruded from the inner side vessel and the combustion type power tool can be driven stably even at the low temperatures.

Further, according to the embodiments, the fuel gas can be vaporized even when the combustion type power tool is at low temperatures and the combustion type power tool can be driven stably.

As described above in details, the embodiments provide the inexpensive fuel gas without deteriorating the function of the gas nailing machine and the industrial applicability is extremely significant.

What is claimed is:

1. A combustion type power tool comprising:

a housing;

a head portion being provided at a vicinity of an end of the housing, and the head portion being formed with a fuel gas path;

a cylinder being fixed to inside of the housing;

a nose being extended to a lower side from a lower end portion of the cylinder;

a push lever provided along the nose, the push lever being movable when the push lever is pressed to a workpiece;

a piston reciprocally slidable to the cylinder in an axial direction of the cylinder, the piston being capable of partitioning the cylinder into a piston lower chamber and a piston upper chamber in the cylinder;

a combustion chamber frame being movably guided at inside of the housing, the combustion chamber frame capable of being brought into contact with and being separated from the head portion in cooperation with movement of the push lever, the combustion chamber frame forming a combustion chamber with the head portion and the piston; and a connecting unit being extended along a side face of the cylinder, for connecting the push lever and the combustion chamber frame, wherein the combustion type power tool is driven by a fuel gas, and wherein the fuel gas consists essentially of 40 to 95 weight % of 1-butene and the remainder being propane.

2. The combustion type power tool according to claim 1, wherein the 1-butene of the fuel gas is equal to or higher than 59 weight %.

3. A combustion type power tool comprising:

a housing;

a head portion being provided at a vicinity of an end of the housing, and the head portion being formed with a fuel gas path;

a cylinder being fixed to inside of the housing;

a nose being extended to a lower side from a lower end portion of the cylinder;

a push lever provided along the nose, the push lever being movable when the push lever is pressed to a workpiece;

a piston reciprocally slidable to the cylinder in an axial direction of the cylinder, the piston being capable of partitioning the cylinder into a piston lower chamber and a piston upper chamber in the cylinder;

a combustion chamber frame being movably guided at inside of the housing, the combustion chamber frame capable of being brought into contact with and being separated from the head portion in cooperation with movement of the push lever, the combustion chamber frame forming a combustion chamber with the head portion and the piston; and a connecting unit being extended along a side face of the cylinder, for connecting the push lever and the combustion chamber frame, wherein the combustion type power tool is driven by a fuel gas, and wherein the fuel gas consists essentially of 56 to 96 weight % of 1-butene and the remainder being propylene.

4. The combustion type power tool according to claim 3, wherein the 1-butene is equal to or higher than 70 weight % in the fuel gas.

5. A compressed gas container for a combustion type power tool, comprising:

an outer side vessel filled with a propulsion gas;

an inner side vessel being provided at inside of the outer side vessel, and the inner side vessel being filled with a fuel gas;

a valve capable of injecting the fuel gas in the inner side vessel to outside of the outer side vessel; and a metering valve being selectively connectable to the valve the metering valve being capable of measuring an amount of injecting the fuel gas, wherein the fuel gas consists essentially of 40 to 95 weight % of 1-butene and the remainder being propane.

6. The compressed gas container for a combustion type power tool according to claim 5, wherein the 1-butene is equal to or higher than 59 weight % in the gas.

7. A compressed gas container for a combustion type power tool, comprising:

an outer side vessel filled with a propulsion gas;

an inner side vessel being provided at inside of the outer side vessel, and the inner side vessel being filled with a fuel gas, and propulsion gas pressure being greater than fuel gas pressure;

a valve capable of injecting the fuel gas at inside of the inner side vessel to outside of the outer side vessel; and a metering valve selectively connectable to the valve, the metering valve being capable of measuring an amount of injecting the fuel gas, wherein the fuel gas consists essentially of 56 to 96 weight % of 1-butene and the remainder being propylene.

8. The compressed gas container for a combustion type power tool according to claim 7, wherein the 1-butene is equal to or higher than 70 weight % in the gas.

9. A combustion type power tool comprising:

a housing;

a cylinder disposed in the housing;

a piston disposed slidably in the cylinder;

a combustion chamber frame being movably guided at inside of the housing, the combustion chamber frame forming a combustion chamber with a head portion of the housing and the piston; and a gas container having an outer side vessel filled with a propulsion gas and an inner side vessel disposed in the outer side vessel and filled with a fuel gas and a valve for supplying the fuel gas into the combustion chamber;

wherein propulsion gas pressure is greater than fuel gas pressure, and the fuel gas consists essentially of 40 to 95 weight % of 1-butene and the remainder being propane.

10. A combustion type power tool comprising:

a housing;

a cylinder disposed in the housing;

a piston disposed slidably in the cylinder;

a combustion chamber frame being movably guided at inside of the housing, the combustion chamber frame forming a combustion chamber with a head portion of the housing and the piston; and a gas container having an outer side vessel filled with a propulsion gas and an inner side vessel disposed in the outer side vessel and filled with a fuel gas and a valve for supplying the fuel gas into the combustion chamber;

wherein propulsion gas pressure is greater than fuel gas pressure, and the fuel gas consists essentially of 56 to 96 weight % of 1-butene and the remainder being propylene.

11. A combustion type power tool comprising:

a housing;

a cylinder disposed in the housing;

a piston disposed slidably in the cylinder;

a combustion chamber frame being movably guided at inside of the housing, the combustion chamber frame forming a combustion chamber with a head portion of the housing and the piston; and a gas container for storing and supplying a fuel gas into the combustion chamber, wherein the fuel gas consists essentially of 1-butene and propane, and concentration of the 1-butene is equal to or lower than 95 weight %.

12. The combustion type power tool of claim 11, wherein the concentration of 1-butene is higher than concentration of propane.

13. A combustion type power tool comprising:

a housing;

a cylinder disposed in the housing;

a piston disposed slidably in the cylinder;

a combustion chamber frame being movably guided at inside of the housing, the combustion chamber frame forming a combustion chamber with a head portion of the housing and the piston; and a gas container for storing and supplying a fuel gas into the combustion chamber, wherein the fuel gas consists essentially of 1-butene and propylene, and concentration of the 1-butene is equal to or lower than 96 weight %.

14. The combustion type power tool of claim 13, wherein the concentration of 1-butene is higher than concentration of propylene.

* * * * *